United States Patent [19]

Preusser et al.

[11] 4,207,081

[45] Jun. 10, 1980

[54] PROCESS FOR GASIFYING FINE GRAINED AND DUST-LIKE SOLID FUELS

[75] Inventors: Gerhard Preusser, Essen; Karl-Heinz Dutz, Herten; Eberhard Goeke, Essen, all of Fed. Rep. of Germany

[73] Assignee: Krupp-Koppers GmbH, Essen, Fed. Rep. of Germany

[21] Appl. No.: 878,746

[22] Filed: Feb. 17, 1978

[30] Foreign Application Priority Data

Feb. 19, 1977 [DE] Fed. Rep. of Germany ..... 2707266

[51] Int. Cl.[2] ..... C10J 3/46

[52] U.S. Cl. ..... 48/210; 48/86 R; 406/74; 414/217; 414/786

[58] Field of Search ..... 214/17 B, 152; 222/194, 222/361; 48/DIG. 4, 197 R, 206, 210, 86 R; 252/373; 406/64, 67, 74; 414/217, 786

[56] References Cited

U.S. PATENT DOCUMENTS

| | | | |
|---|---|---|---|
| 1,396,859 | 11/1921 | Long | 214/17 B |
| 1,875,921 | 9/1932 | Grant et al. | 214/17 B |
| 2,604,216 | 7/1952 | Martin | 214/17 B |
| 2,614,915 | 10/1952 | Hirsch | 48/DIG. 4 |
| 3,042,229 | 7/1962 | Winter | 214/17B |
| 3,775,071 | 11/1973 | Haffert et al. | 214/17 B |
| 3,797,709 | 3/1974 | Ivanovicl | 406/74 |
| 4,049,133 | 9/1977 | Staudinger | 214/17 B |
| 4,140,228 | 2/1979 | Hathaway et al. | 414/786 |
| 4,148,405 | 4/1979 | Hathaway | 414/786 |
| 4,150,759 | 4/1979 | Bell | 414/217 |

*Primary Examiner*—S. Leon Bashore
*Assistant Examiner*—Peter F. Kratz
*Attorney, Agent, or Firm*—Michael J. Striker

[57] ABSTRACT

Fine grained fuel such as coal dust is gasified at an elevated pressure by passing the fuel from a supply tank which is at atmospheric pressure by pump means into a pressurized lock basin and therefrom into the gasifier, the fuel during such movement retaining its loose consistency. This can be accomplished for instance by a solid piston pump which is only partially filled with the fuel. Thus, agglomerations are avoided and the fuel is directly conveyed into the gasifier in flowable and fluidizable form without the necessity of being reconverted into a finely divided form.

9 Claims, 10 Drawing Figures

PROCESS FOR GASIFYING FINE GRAINED AND DUST-LIKE SOLID FUELS

CROSS-REFERENCE TO RELATED APPLICATION

The pump described herein forms the subject matter of an application for a piston pump for use in gasifying fine grained and dust-like fuel, filed as Ser. No. 878,747 by Ulrich GEIDIES simultaneously herewith.

BACKGROUND OF THE INVENTION

The present invention relates to a process for gasifying fine grained and dust-like solid fuel at an elevated pressure by passing the fuel by way of a pressurized lock basin into the gasifier.

One of the central problems of this type of gasification (partial oxidation) is the conveyance of the fuel into the gasifying chamber which is at a greatly elevated pressure.

To solve this problem a process has been proposed in which the fine grained or dust-like fuel is mixed with a suitable liquid, preferably water or low boiling hydrocarbons to form a suspension. The suspension is then condensed by means of a pump to the pressure level of the gasifier. The liquid is subsequently subjected to evaporation which causes a fluidization of the fuel particles which thus are gasified in a comparatively finely divided condition.

The shortcoming of this process lies in the fact that the evaporated liquid either takes part in the gasification and thus undesirably affects its results or that complex special installations are necessary to effect a prior separation and recirculation of the liquid.

Experiments have also been carried out (without publication) to convey the fuel from the supply tank which is under normal pressure into a space which is at elevated pressure by using a system of two lock basins which are alternatingly depressurized for filling and pressurized for evacuation. However, this approach proved to require expensive apparatus and substantial energy was necessary for the compression because of the alternating depressurization and condensing of an inert gas in the lock basins. This resulted in a substantial increase of the cost.

The assignee of the present case in its plant has also experimented with a system where the fine grained and dust-like fuel was directly advanced into the pressurized gasifier chamber by means of piston pumps, that is without using a mash with an auxiliary liquid. These tests were based on the assumption that an agglomeration of the moving fuel was not only unavoidable but desirable. The tests were therefore carried out in a manner that the fuel was condensed in a channel-like passage between the chambers of different pressure to form a sealing plug which was supposed to provide the sealing of the chamber at higher pressure against the space at atmospheric pressure. However, it was found that with this method the sealing plug did not provide an adequate gas and pressure seal. Besides, the grain size of the initial fuel could not be retained with this procedure. Instead, an agglomeration took place which resulted in briquette-like bodies.

In this process it was therefore necessary again to convert the formed sealing plug to a finely divided form because for the subsequent gasification it was absolutely necessary that the fuel was available in a loosened-up condition, that is, in fine grained or dust-like form. This re-comminution of the sealing plug constituted a substantial problem and this process was therefore not industrially used.

The present invention therefore has the object to provide for a process for gasification of fine grained and dust-like fuels at elevated pressure which avoids the difficulties described. It is in particular an object to provide for a process where the fuel is conveyed into the gasifying space in flowable and fluidizable form so that an intermediate re-comminuting of the fuel is not necessary.

It is also an object of the invention to provide for a process where the fuel can be conveyed in a comparatively simple manner from the supply tank which is at atmospheric pressure into the gasifying chamber which is at an elevated pressure without using for this purpose an auxiliary liquid.

SUMMARY OF THE INVENTION

The object of the invention is solved by passing the fuel from the supply tank which is at atmospheric pressure by pump means into a pressurized lock basin and therefrom into the gasifier without causing any agglomeration of the fuel during its movement. The pump means preferably are constituted by a solids pump, that is a pump adapted for moving solid or highly viscous media. This is in particular accomplished by filling the cylinder space of the solids pump only partially, and thus causing a condensation of the gaseous medium present in the remaining cylinder space. Thus, it is avoided that the essential properties of the fuel are undesirably affected by agglomeration. These properties include the grain size, the grain spectrum, the grain properties, the flow properties and the fraction of volatile components.

The amount of fuel conveyed can be adjusted not only by the partial filling of the solids pump, but also by adjusting the speed of its reciprocating movements.

The invention also contemplates to make the feeding of the fuel into the lock basin conditional upon the supply level in the supply tank by providing control switches in the lock basin which effect the starting or cutting out of the solids pump upon reaching specific minimum and maximum levels.

Preferably, the lock basin is maintained at a pressure equal or about equal to that of the gasifier. This implies that the process of the invention can be carried out both at a comparatively low gasification pressure such as about 5 atm above atmospheric as well as at a gasification pressure above 20 atm above atmospheric as it is customarily used presently in the gasification of coal dust. The gasification pressure may even be up to 80 atm above atmospheric. Actually, there are hardly any limitations regarding the conditions of the gasification or the type of fuel used. The conditions may be those customary in present gasification processes and details of the gasification process therefore are not further discussed herein.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 9:
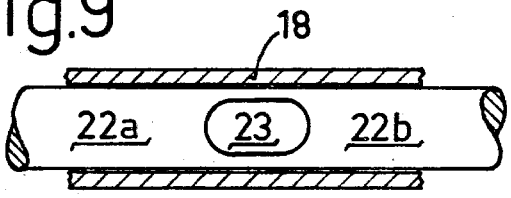
Figure 10:
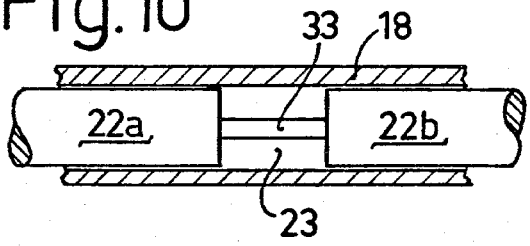

More particularly:

FIGS. 2 to 8 are vertical sections in simplified form illustrating the different positions of the piston during the complete run;

FIG. 9 is a horizontal section through a part of the piston and the cylinder; and FIG. 10 illustrates another embodiment of the piston of the pump.

DESCRIPTION OF THE PREFERRED EMBODIMENTS

Figure 1:
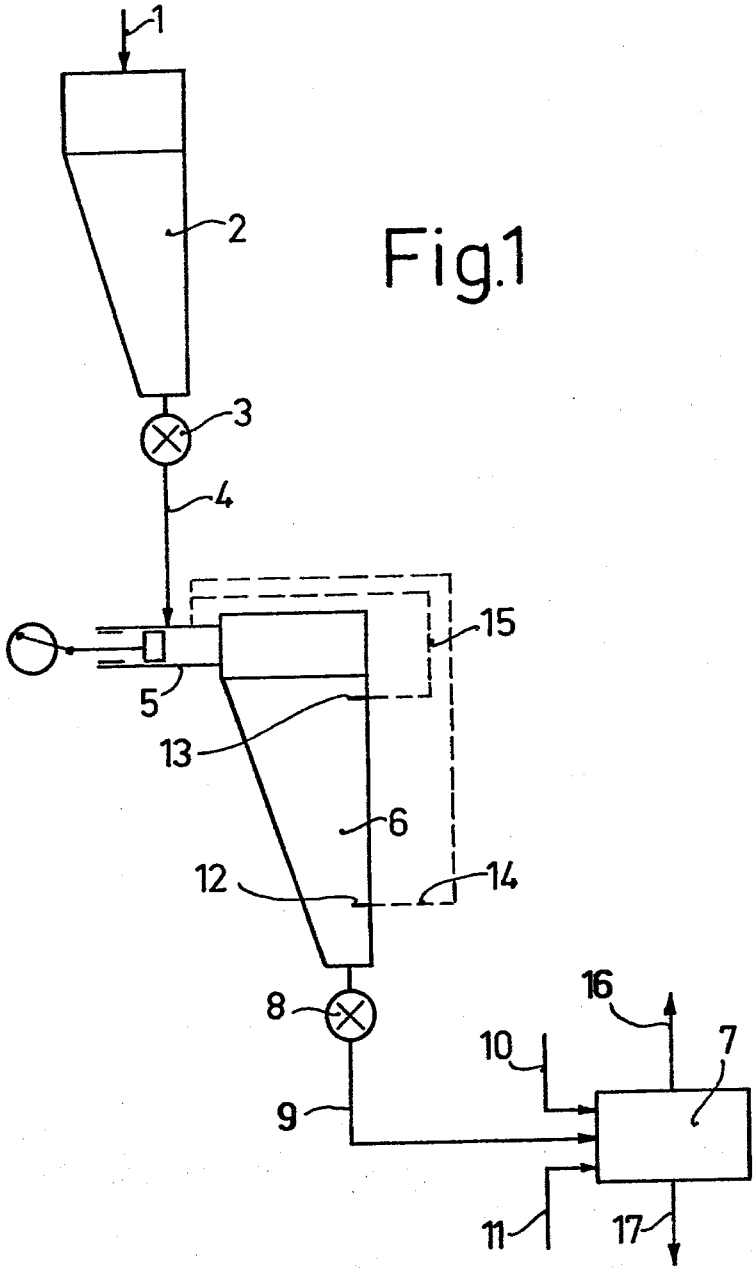
FIG. 1 illustrates an installation for carrying out the process of the invention, the showing being in diagrammatic form.

With specific reference now to FIG. 1 it will be seen that the fine grained or dust-like fuel is passed through a supply duct 1 into the supply tank 2. The fuel then is passed by means of a valve 3 and duct 4 into the solids pump 5. This pump is permanently connected with its collecting pipe to the lock basin 6. The lock basin is under the same elevated pressure as the gasifier 7.

The basin is then partially filled with the fuel resulting in a condensing of the gas in the remaining space of the basin. Thus, an agglomeration is avoided and the fuel can be passed through the feeder valve 8 and the duct 9 into the gasifier 7 while still in flowable and fluidizable form.

The gasifier itself may be of well-known construction. It may, for instance, be a Koppers-Totzek gasifier.

The ducts 10 and 11 are the inlet ducts for the reaction media such as air or oxygen and hydrogen. The generated gas is then withdrawn through duct 16 from the gasifier while the slag is removed through the duct 17.

In the lock basin 6 switch contacts 12 and 13 are provided which upon reaching of a minimum or maximum, level of the fuel actuate through the impulse wires 14 and 15 the starting or switching off of the solids pump 5.

Pumps for Use in the Process of the Invention

There are various pumps that may be used in the process of the invention. One is the double piston pump of a design which has particularly been used for conveying thick highly viscous media or sludges with high contents of solids. A pump of this type is for instance the pump DRKP of the Seiler Company of Erlinsbach near Aarau, Switzerland.

In this pump two parallel hydraulically driven and electrically or pneumatically controlled pistons are used which alternately convey the fuel into a common collector tube which may be permanently attached to the pressurized lock basin. During the suction cycle of the pistons a vacuum is formed which permits to obtain the fuel by suction from the fuel bin which is at normal pressure.

A preferred piston pump specifically designed for the process of the invention is illustrated in FIGS. 2 to 10.

Figure 2:
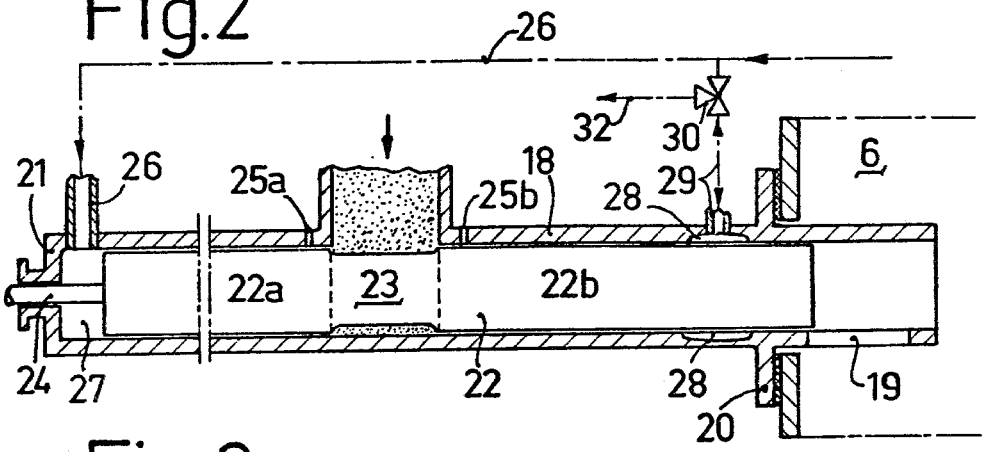
FIGS. 2 to 10 illustrate preferred embodiments of a piston pump for use in the process of the invention.

With reference first to FIG. 2 it will be seen that the pump in this case is provided with a tube or cylinder disposed horizontally which at its top side is connected with the pipe 4 from the supply tank 2 (see FIG. 1). One end of the cylinder 18 extends into the lock basin 6 (see FIG. 1). The cylinder at that place has an outlet opening 19. The flange 20 provides a gas and pressure seal between the cylinder 18 and the lock basin 6.

The other end of the cylinder is likewise provided with a gas- and pressure-tight seal. Within the cylinder a piston 22 is disposed for horizontal movement. Preferably, the piston has a round or oval cross section.

The piston in its central area is provided with a hollow space 23, thus forming two piston sections **22*a* and 22*b***.

It is noted, however, that as distinguished from the embodiment shown in FIGS. 2 to 8, the hollow space 23 may also have a spherical configuration which would permit a certain volume increase.

The actuation of the piston 22 may for instance be effected through a piston rod 24 which may be connected with a suitable, not shown, driving motor or similar.

In the position shown in FIG. 2 the hollow space 23 is in alignment with the pipe 4 and thus prepared for receiving fuel from the supply tank.

Laterally of the pipe 4 there are provided two outlet openings **25*a* and 25*b* which permit releasing the inert gas, which as will be discussed below may be used to drive the pump, and, if desired, withdrawing it through suitable ducts. The inert gas may for instance be nitrogen. These outlets will prevent portions of the inert gas from reaching the supply tank 2 through the pipe 4 and thus to interfere with the filling of the hollow space 23**.

Near the end 21 of the cylinder there is an inlet duct 26 through which inert gas may be introduced into the space 27 rearwards of the piston 22, this gas being under the same or approximately the same pressure as is maintained in the lock basin 6. Through this pressure equalization between the lock basin and the space 26 a saving of energy necessary to move the piston is obtained since in that case only the friction and not the elevated pressure must be overcome when moving the piston.

There is furthermore provided at the inner wall of the cylinder 18 shortly ahead of the sealing flange 20 a recess 28 which is connected with a duct 29. The function of this duct will be discussed below.

In the position shown in FIG. 2 the fuel withdrawn from the supply tank 2 through the passage 4 drops directly into the hollow space 23. This is the terminal position of the piston to the left.

Figure 3:
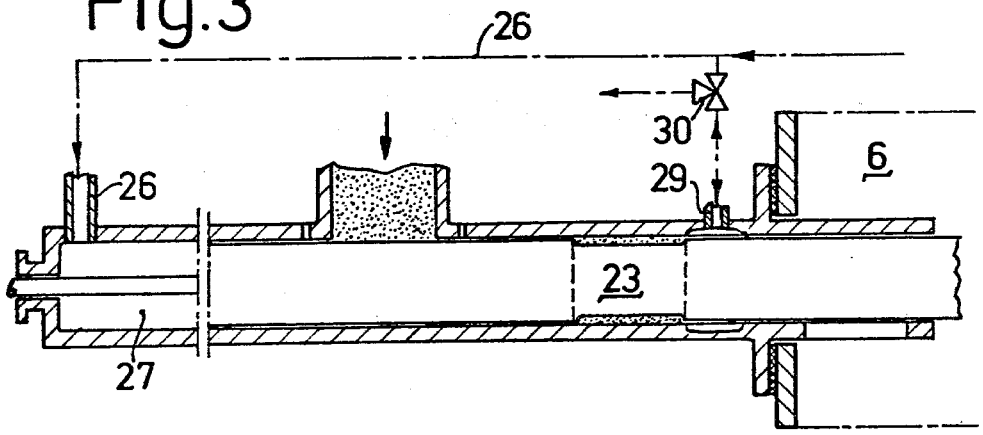

The piston then is moved to the right and reaches the position shown in FIG. 3 where the hollow space 23, which has been filled with fuel, moves into alignment with the duct 29. Through this duct inert gas is passed into the fuel until the pressure in the hollow space 23 is about equal to the pressure in the lock basin 6. The duct 29 is, for instance, provided with a three-way valve 30 which connects the duct with the supply duct 26 for the inert gas which also leads into the space 27 rearwards of the piston.

Instead of the three-way valve 30 any other suitable device such as provided by two separate valves may be used.

Figure 4:
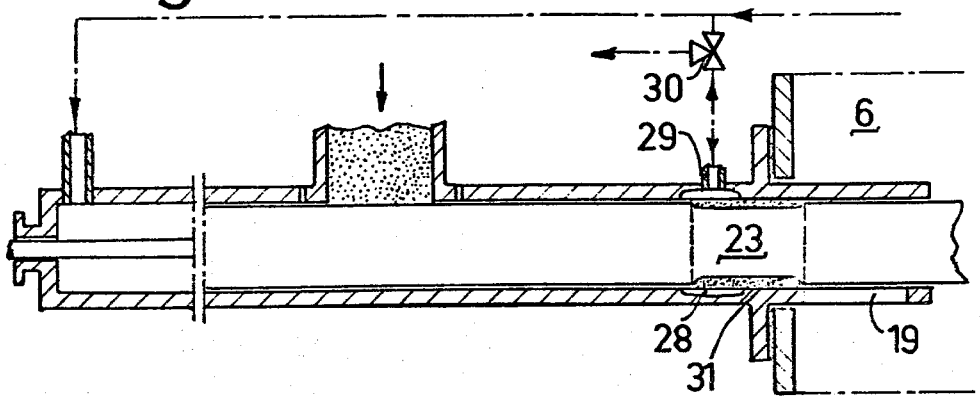

The three-way valve 30 is left in the position for introduction of the inert gas through the duct 29 until the piston moves further to the right as shown in FIG. 4. In this position it will be seen that the bottom edge 31 of the hollow space 23 has reached the edge of the outlet opening 19. As appears from this figure a notch 28 is provided in a wall of the cylinder which will permit the inert gas to enter the hollow space 23 both from the top and the bottom.

Figure 5:
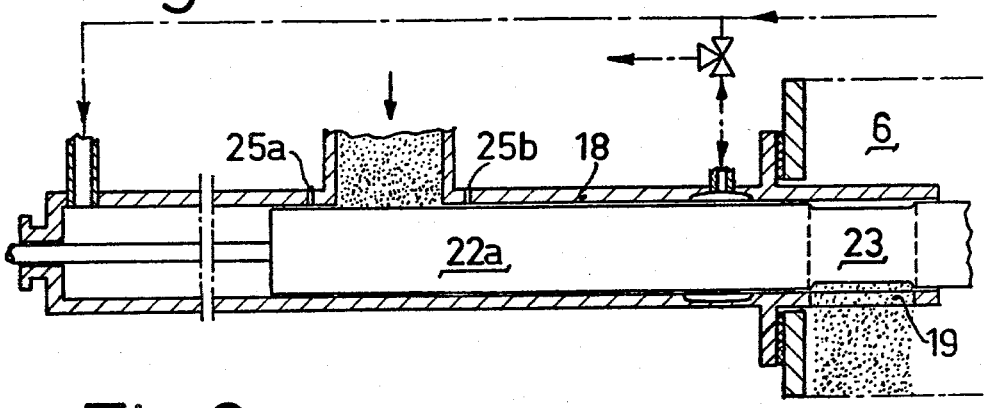

FIG. 5 then shows the right-hand terminal position of the piston 22 in which the complete evacuation of the hollow space through the discharge opening 19 takes place. This discharge opening is provided at the end of the cylinder 18 where the cylinder extends into the lock basin 6.

In the position shown in FIG. 5 the three-way valve 30 is adjusted to close the duct 29 so that no further inert gas is either introduced into or discharged from the cylinder.

As soon as all fuel from the hollow space 23 has been discharged into the lock basin, the piston is again moved in the reverse direction, that is from right to left.

Figure 6:
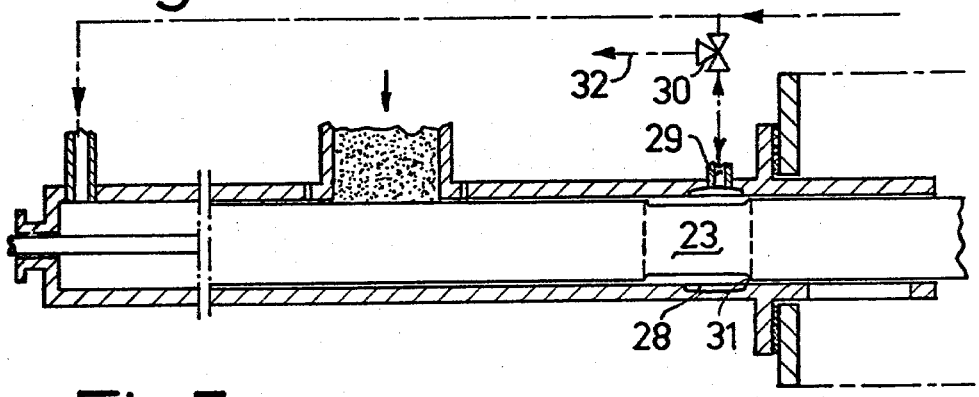

If the piston then reaches the position shown in FIG. 6 where the lower edge 31 is in line with the righthand edge of the notch 28, the three way valve 30 is set to permit the inert gas to be discharged from the hollow space 23 through the ducts 29 and 32.

Figure 7:
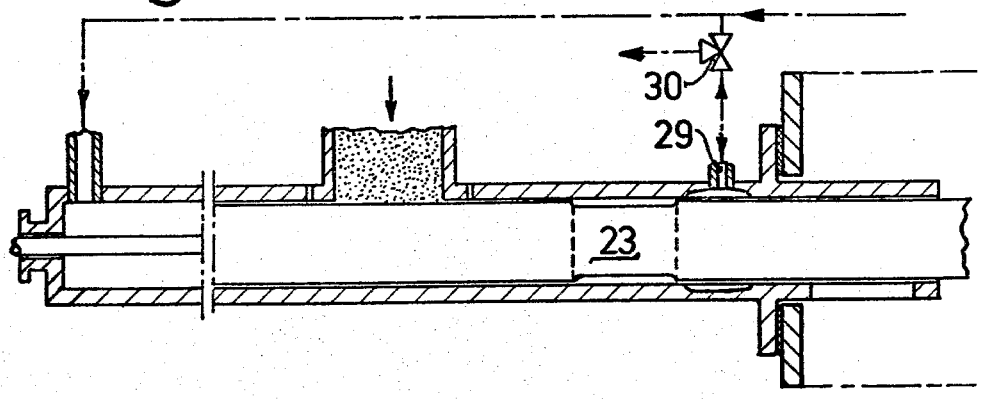

The discharge of gas is complete as soon as the piston 22 reaches the position shown in FIG. 7. The three-way valve is then adjusted to close the duct 29.

It will be understood that the position of the three-way valve 30 may also be automatically controlled depending on the position of the piston.

Figure 8:
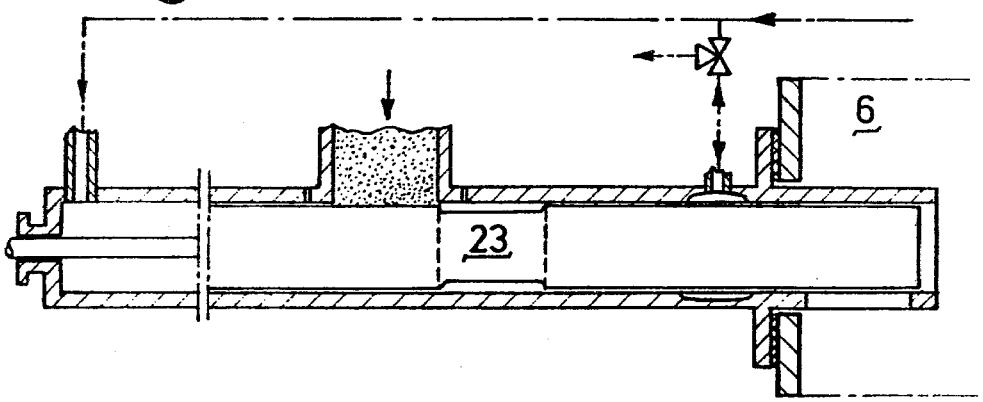

Upon further movement of the piston to the left the position shown in FIG. 8 will be reached where the filling of the hollow space with fuel is about again to commence. Following this position in FIG. 8, the position of FIG. 2 will be reached which has been described above and which constitutes the beginning of the next run.

The movement of the piston 22 both from left to right and in reverse direction may be carried out either in continuous or in discontinuous sequence.

It will be understood that in FIGS. 2 to 8 all reference numbers have the same meaning, but only those reference numbers are entered which are necessary for an understanding of the particular figure.

In FIG. 9 a horizontal section through the center part of the piston is shown. This figure shows the cross section of the hollow space 23 which corresponds about to the inside diameter of the passage 4. As will be seen the piston because of the central hollow space 23 may be considered to have two sections 22*a* and 22*b*.

FIG. 10 illustrates a different embodiment where these two sections 22*a* and 22*b* are joined by a narrow cross bar 33. The space around the cross bar then constitutes the hollow space 23 which is available for the fuel.

The drive mechanism for the piston 22 may be conventional, for instance may be of a hydraulic, mechanical or pneumatic design. The actuation as indicated in FIGS. 2 to 8 is then transmitted to the piston by the piston rod 24. It is, however, also possible that a direct pneumatic drive may be used in which the rearward space 27 may be employed to provide the necessary pressure impulse for the piston movement without use of any piston rod.

The piston 22 and the inner wall of the cylinder 18 must of course be provided with the necessary sealing and sliding elements (gaskets). These have not been shown in the drawing. Their number and design depend to a large extent on the existing pressure differential between the supply tank 2 and the lock basin 6.

The inert gas which is freed through the pressure release through duct 25*a*, 25*b* and 29 may also be collected and be passed into the supply tank 2 for purpose of dust removal from the fuel.

As indicated by the dot-dash lines in the different figures, the length of the piston and cylinder have not been fully shown. In actual practice the piston portion 22*a* as indicated in FIG. 2 must have a sufficient length that when the piston is at the right terminal position the hollow space 23 is in alignment with the exit opening 19, while simultaneously the passage 4 and the outlet openings 25*a* and 25*b* are closed through the piston.

On the other hand, as appears in FIG. 2 the piston section 22*b* must also have a sufficient length so that at the left terminal position the hollow space 23 is exactly in alignment with the passage 4 and the duct 29 and notch 28 are closed by this part of the piston.

The following is an example for the conveyance of coal dust of a bulk weight of 0.4 kg/l and a specific weight of 1.8 kg/l into a lock basin which is at a pressure of 30 atm above atmospheric. The following are the data applying to this example:

piston diameter: 300 mm
volume of the hollow space 23: 20 l
rate of loading of the hollow space: 80%
delivery performance: 7,860 kg/h per piston
required nitrogen amount: about 600 $Nm^3/h$ If a lock basin system is used which comprises two lock basins which alternately are subjected to pressure release and condensation an amount of for instance 2000 $Nm^3/h$ of nitrogen would be necessary for the same delivery performance.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A process of conveying coal powder or coal dust by way of a pressurized lock-type basin into a gasifier without causing aggregation or compacting of the coal powder or dust, the said process comprising pouring the powder or dust at atmospheric pressure into a receiving receptacle and filling the receptacle only partially so as to preserve the loose consistency of the powder-dust, then moving the receptacle to align it with a gas duct and passing pressurized gas into the receptacle through said duct, the pressure of the gas being substantially equal to the pressure in said pressurized lock-type basin, thereupon moving the receptacle further to cause it to enter the lock-type basin and to discharge the coal powder or dust by gravity out of the receptacle into the lock-type basin, and finally passing the coal powder or dust from the lock-type basin into the gasifier where the coal is subjected to gasification by heat and pressure, the pressure in the lock-type basin and in the gasifier being about equal wherein the receptade is provided in a piston or between pistons reciprocating in a cylinder so as to be successively aligned below the filling station for the coal, below the gas duct and finally within the lock-type basin for the discharge of the coal.

2. The process of claim 1 wherein the pressure gas left in the receptacle is discharged during the back-stroke of the piston through said gas duct by reversal of the flow of the gas in said duct.

3. The process of claim 1 wherein a gas under pressure acts on the piston so as to support or effect the reciprocating motion of the piston.

4. The process of claim 3 wherein the said pressure gas is discharged after acting on the piston so as to prevent its interference with the coal filling step.

5. The process of claim 3 wherein the gas acting on the piston is substantially at the same pressure as the gas present in the lock-type basin.

6. The process of claim 3 wherein the gas acting on the piston and the gas passed into the coal-holding receptacle are obtained from the same source.

7. The process of claim 3 wherein the pressurized gas acting on said piston and the pressurized gas passed into said coal holding receptacle are an inert gas.

8. The process of claim 3 wherein the pressurized gas may alternatively (a) be caused to act on the piston and to enter the coal holding receptacle and (b) be discharged during the reverse stroke of the piston, the different gas flows being controlled by a multiple-way valve.

9. The process of claim 8 wherein the multiple way valve is automatically controlled by the position of the piston.

* * * * *